United States Patent [19]

Eisele

[11] Patent Number: 4,775,094

[45] Date of Patent: Oct. 4, 1988

[54] LOOSE INSERT MAILER

[76] Inventor: Ronald B. Eisele, 3086 Camino Graciosa, Thousand Oaks, Calif. 93060

[21] Appl. No.: 522,497

[22] Filed: Aug. 12, 1983

[51] Int. Cl.[4] ..... B65D 27/38

[52] U.S. Cl. ..... 229/69; 206/610; 206/632

[58] Field of Search ..... 29/68 R, 69, 71, 75, 29/92.1; 206/610, 632

[56] References Cited

U.S. PATENT DOCUMENTS

| | | | |
|---|---|---|---|
| 1,518,183 | 12/1924 | Dailey | 229/92.1 |
| 2,056,472 | 10/1936 | Lewis | 206/610 |
| 3,111,257 | 11/1963 | Peach | 229/68 R |
| 3,420,432 | 1/1969 | Cooper | 229/71 |
| 3,837,565 | 9/1974 | Johnsen | 229/68 R |
| 3,905,545 | 9/1974 | Juszak et al. | 229/69 |
| 4,012,268 | 3/1977 | Johnsen | 229/69 X |
| 4,157,759 | 6/1979 | Dicker | 206/610 |

*Primary Examiner*—Stephen Marcus
*Assistant Examiner*—Bryon Gehman
*Attorney, Agent, or Firm*—Kelly, Bauersfeld & Lowry

[57] ABSTRACT

A rectangular mailing envelope is formed with perforations running transversely, that is, in the direction of the width of the envelope, adjacent to one end to define a pull tab. Removal of this pull tab provides a large access opening for easy retrieval of a loose insert which may comprise a single message on a paper or a return envelope together with other documents. By providing transverse perforations to define the tab, the envelopes can be mass-produced at high speeds by moving plies of paper in the direction of the width of the envelopes, the perforated paths running in the direction of movement of the plies so that the perforations can be formed while the plies are in motion.

4 Claims, 2 Drawing Sheets

LOOSE INSERT MAILER

FIELD OF THE INVENTION

This invention relates generally to loose insert mailers or what are referred to sometimes as continuous mailers, and more particularly to an improved mailer construction facilitating mass production of the mailers.

BACKGROUND OF THE INVENTION

Loose insert or continuous mailers are well known in the art. These mailers are normally used in business to send out invoices or other information normally requiring a response. In this respect, the mailer will usually include a mailing envelope with a return envelope inside the mailing envelope.

Such combined envelopes are normally mass produced by a continuous manufacturing process involving the movement of over-lying plys of paper along a conveyor system wherein appropriate glueing or heat sealing operations are carried out as well as provision of cut-outs in the outer or mailing envelope facilitating opening of the same to gain access to the interior. Often times there are provided perforations instead of cut-outs to define a tear tab which can be easily removed to gain access to the interior of the envelope.

In all constructions of which I am aware, such tear tabs are defined by parallel spaced perforations running along a longitudinal edge of the envelope. An example of one such continuous mailer is shown in U.S. Pat. No. 4,157,759. The continuous mailer described in this patent illustrates clearly a perforated pull tab along the rear top longitudinal edge of the envelope. This tab is designed to remove simultaneously a protective covering of the flap seal for the return envelope. As a result, the removal of the outer tab to gain access to the interior automatically conditions the return envelope for immediate sealing and mailing back to the sender.

Where perforations run longitudinally along an evelope mass produced by movement along the direction of the width of the envelope, the movement of the web or various plys in producing the same must be slowed substantially while the perforations along the length of the envelope are formed. Further slowing occurs when longitudinal glue lines must be added to a return envelope flap.

BRIEF DESCRIPTION OF THE PRESENT INVENTION

With the foregoing in mind, the present invention contemplates an improved construction for a continuous mailer which can be more easily mass produced and opened than prior art mailers of which I am aware.

More particularly, the mailer of the present invention includes a rectangular mailing envelope comprised of a front ply and a rear ply fastened together about all marginal edges. The front ply includes an address receiving area and the rear ply has formed therein parallel perforated paths spaced a first given distance apart extending from a longitudinal marginal edge of the rear ply transversely across the rear ply adjacent to one end of the envelope to terminate at the opposite marginal edge. The rear ply is cut along a straight line between two points on said paths spaced a second given distance from said opposite marginal edge, this cut defining with the remaining perforations between the points and the first longitudinal edge a pull tab. The cut itself provides an opening to the interior of the envelope by means of which a person can grasp and pull the tab away from the remaining rear ply to provide a large transverse access opening into the interior of the envelope.

Because the perforations run transversely or in the direction of the width of the envelope, which direction is the same as the paper grain and the movement of paper plys in mass production of the envelopes, the perforations can be made while the plys are moving at high machine speed, as in presses and collators all to the end that production is more efficient. Further, because the pull tab operates in a transverse direction rather than a longitudinal direction, there is less tear distance and the tear direction is with the grain of the paper. Thus the tab can be moved quickly and easily with less risk of damaging the return envelope.

BRIEF DESCRIPTION OF THE DRAWINGS

A better understanding of this invention will be had by referring to the accompanying drawings in which.

DETAILED DESCRIPTION OF THE INVENTION

Figure 1:
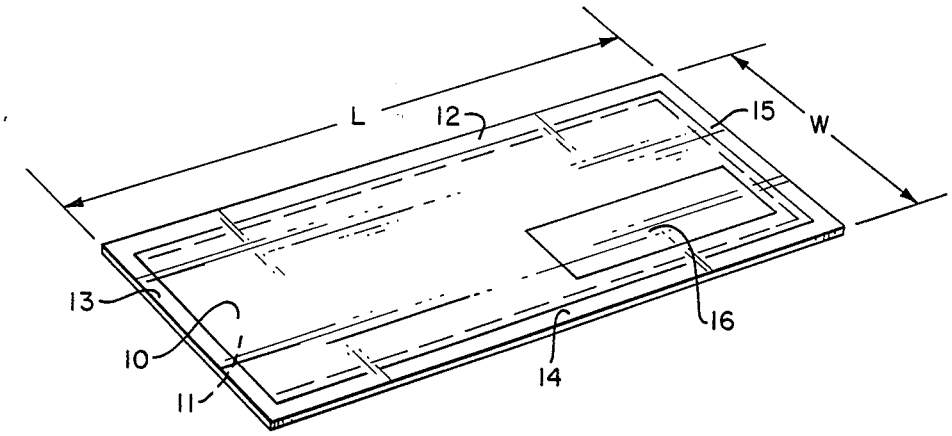
FIG. 1 is a three quarter front perspective view of a rectangular mailing envelope constituting one embodiment of the loose insert mailer of this invention.
Figure 2:
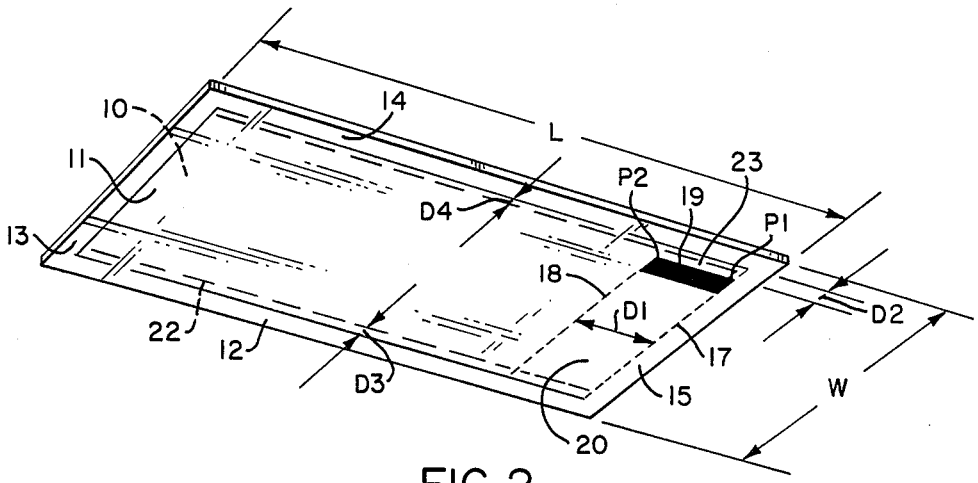
FIG. 2 is a three quarter rear perspective view of the envelope of FIG. 1.

Referring to both FIGS. 1 and 2, the loose insert mailer includes a rectangular mailing envelope comprised of a front ply 10 and a rear ply 11 fastened together about all marginal edges as indicated at 12, 13, 14 and 15. The front ply includes an address receiving area 16.

As shown particularly in FIG. 2, the rear ply 11 includes parallel perforated paths 17 and 18 spaced a given distance apart indicated at D1. These paths extend from the longitudinal marginal edge 12 of the rear ply transversely across the rear ply adjacent to one end of the ply to terminate at the opposite longitudinal marginal edge 14.

A straight cut 19 is shown between two points P1 and P2 on the perforation 17 and 18 spaced a second given distance D2 from the referred to opposite longitudinal margin 14. This cut defines, with the remaining portions of the perforations 17 and 18 extending from the points P1 and P2 to the longitudinal marginal edge 12, a tab 20. Below the cut 19 as illustrated in FIG. 2, the tab 20 may be shaded so as to render immediately visible the end of the tab that includes the cut 19.

The cut 19 itself provides an opening to the interior of the envelope by means of which a person can grasp and pull the tab 20 away from the remaining rear ply to provide a large transverse access opening into the interior of the envelope. This access opening is illustrated at 21 in FIG. 3 wherein the tab 20 is shown after it has been pulled outwardly from the rear ply. An insert 22 is illustrated in FIG. 3 being removed through the access opening 21.

Figure 3:
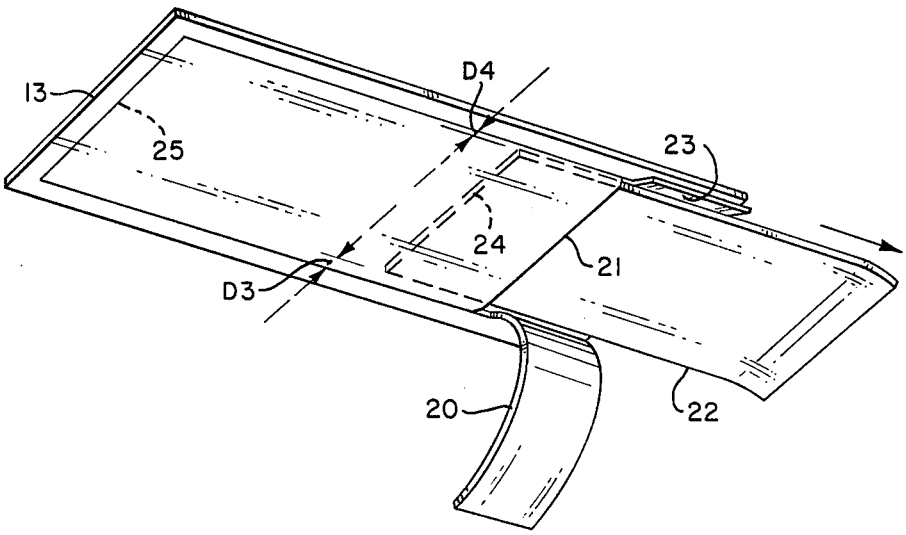
FIG. 3 is a perspective view similar to FIG. 2 illustrating the removal of an insert within the envelope in accord with the present invention.

In a typical mailer as described in FIGS. 1 through 3, the first given distance D1; that is the width of the tab 20, is between one fifth and one seventh the length L of the envelope and the second given distance D2 from the points P1 and P2 to the opposite longitudinal margin 14 is between one twentieth and one twenty-fifth the width W of the envelope.

The first and second given distances D1 and D2 define the length and width of a small rectangular flap 23 best illustrated in FIG. 3 disposed between the opening 19 and the opposite longitudinal marginal edge 14. This flap overlies the adjacent edge of the loose insert 22. By this arrangement, a person grasping the tab 20 by means of the opening 19 cannot inadvertantly grasp the loose insert and possibly tear the same while removing the tab.

To assure that the loose insert 22 has its edge beneath the rectangular flap 23, appropriate attachment means may be provided which can separate in response to a slight pulling force for holding the end 24 of the loose insert to the end 25 of the envelope opposite to the one end closest to the tab. This attachment means assures that the insert will be in a position such that the flap 23 will overlie the adjacent edge of the loose insert.

With respect to the foregoing and with reference to both FIGS. 2 and 3, the described postioning of the insert 22 is such that one longitudinal edge of the insert will be spaced a lesser distance from the inside longitudinal edge of the envelope than the other. Thus, as indicated in both FIGS. 2 and 3, the lower edge of the insert 22 is spaced a distance D3 from the marginal edge 12 of the mailing envelope while its upper edge viewed in FIGS. 2 and 3 is spaced a distance D4, considerably less than D3. The attachment means for maintaining the insert 22 in position may include glue spots or perforations between the end of the insert and the inside of the marginal edge 13 of the envelope. As mentioned, the attachment means is minimal so that a slight pulling force will easily separate and permit easy removal of the insert 22.

Figure 4:
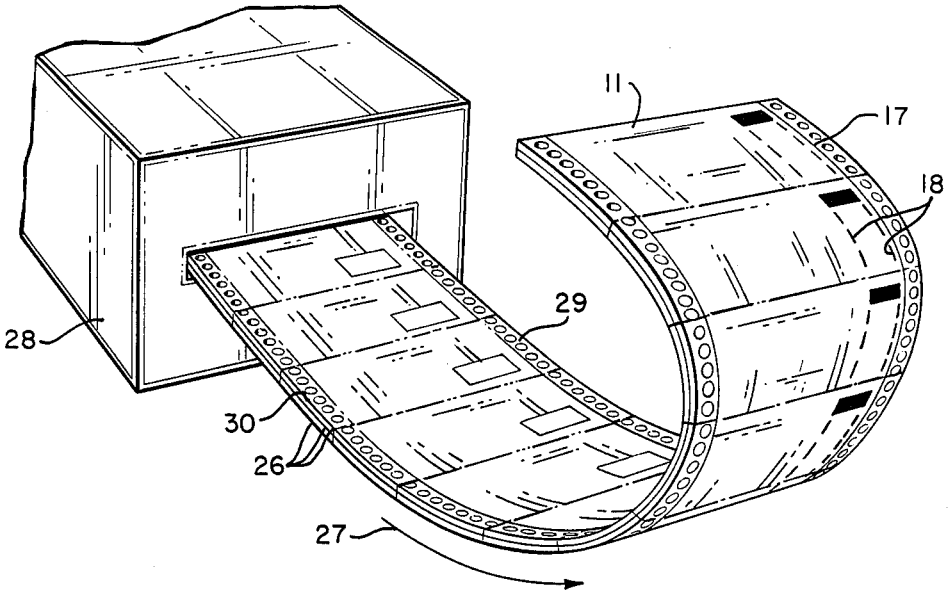
FIG. 4 is a schematic illustration of mass production of envelopes of the type illustrated in FIGS. 1, 2 and 3.

Referring now to FIG. 4 there is shown schematically a means of mass producing the various envelopes. By moving plys of paper 26 in the direction of the width of the mailer, the perforated paths defining the tab shown at 17 and 18 on the underside can be formed in the rear ply of the plys of paper while the same are moving in the direction of the arrow 27.

The finished products in the form of a continuous series of mailers are fed from a manufacturing conveyor schematically indicated by the box 28. The web of envelopes are properly indexed in various moved positions by marginal strips 29 and 30 which have punched holes in the manner of computer print out paper. It will be understood that during the mass production of the envelopes, automatic addressing equipment can insert addresses on the address receiving areas such as 16 described in the mailing envelope of FIG. 1.

Where such addresses are automatically formed or even if the addresses are simply hand written on each of the mailing envelopes, there may be included in the plys 26 a top ply with carbon paper therebeneath overlying the front ply 10 of the envelope. With this arrangement an address formed on the top ply will be reproduced in the address receiving area 16 of the front ply 10 and the top ply can then be removed and serve as a record of the addressee.

Figure 5:
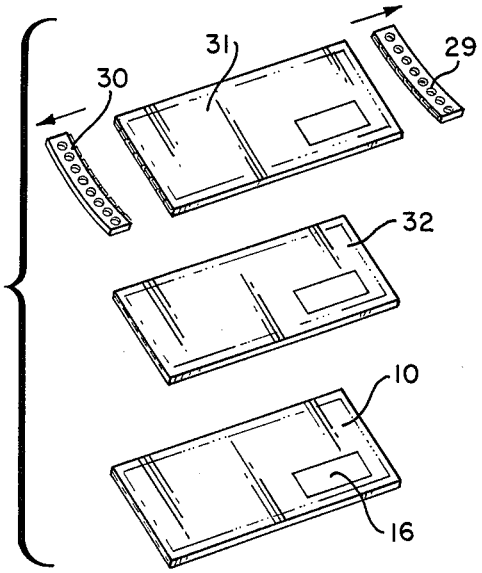
FIG. 5 is an exploded perspective view illustrating various components of the loose insert mailers produced by the apparatus of FIG. 4.

The foregoing is illustrated in FIG. 5 wherein it will be noted that the punched hole marginal edges 29 and 30 are removed from one of the envelope plys taken from the end of the web from the apparatus 28 of FIG. 4. The top ply is illustrated at 31 and the carbon therebeneath illustrated at 32. After inscribing the address on 31, it will, by way of the carbon, appear at the addresss receiving area 16 of the front ply 10 of the mailing envelope. The mailing envelope shown in FIG. 5 may be the same as that described in FIGS. 1,2 and 3.

Figure 6:
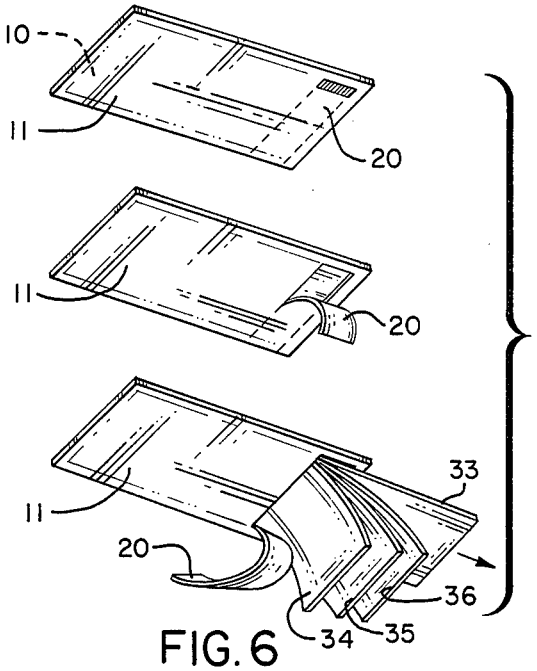
FIG. 6 illustrates further features of the mailer shown in FIG. 5.

Referring to FIG. 6, this particular mailing envelope is shown at three successive stages wherein the same is being opened all as described in FIGS. 1, 2 and 3. Thus, the pull tab 20 is removed from the rear ply 11 as shown in the middle figure and in the bottom figure of FIG. 6, the various inserts are being removed.

Rather than a single insert 22 as described in FIG. 3 the contents of the mailing envelope of FIG. 6 include a return envelope 33 and two additional inserts 34 and 36 with a carbon paper 35 therebetween. With these components, a person receiving a mailing envelope can write a return message on one of the two additional loose inserts and mail it back in the return envelope keeping the other of the additional inserts as a copy of what was sent back.

Figure 7:
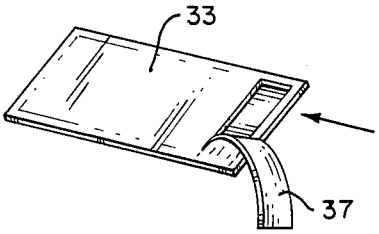
FIG. 7 illustrates a feature of a return envelope provided in the mailer.

FIG. 7 shows the return envelope 33 with an appropiate protecting strip 37 being removed to expose a glue line along a flap so that the return envelope can be properly sealed.

Figure 8:
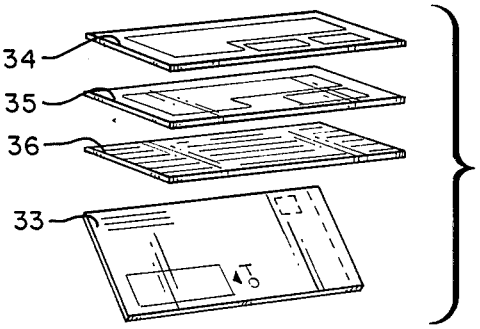
FIG. 8 further illustrates components that may be included in the mailer.

FIG. 8 shows the various components described in FIG. 6 after being turned over and separated, the one insert 34 being shown on top on which a return message may be written this message being reproduced by the carbon paper 35 on the second of the inserts 36. Either the insert 34 or 36 may be placed in the return envelope 33 for mailing back to the sender, the other loose insert serving as copy all as described.

The various inserts in the form of a return mailing envelope and the two additional loose inserts are, per se, known in the art. However, they have not been used in combination with the uniquely designing mailer having the transverse perforation to define the pull tab as set forth herein.

From all of the foregoing, it will now be evident that the present invention has provided an improved loose insert mailer which not only enables production of the mailer to be speeded up but assures that easy access is provided by the specifically designed pull tab arrangement and wherein risks of damaging the material within the mailing envelope when removing the pull tab are minimized. Further, because the tear line is shorter and with the grain of the paper when a transverse tab is provided instead of a longitudinal tab, the tab can be removed more quickly and with less risk of tearing the envelope in areas other than the perforations.

Since the tear tab perforations run in the direction of movement of the web during mass production, there is less chance of inadvertant separation as a result of tension in the web. For example, when perforations run transverse to the web motion, the web is weakened.

The term "image transfer provisions" is used to denote carbon paper or equivalent transfer means.

Various changes falling within the scope and spirit of this invention will occure to those skilled in the art. The loose insert mailer is therfore not to be thought of as limited to the exact construction set forth for illustrative purposes.

I claim:

1. A loose insert mailer, including, in combination:

(a) a rectangular mailing envelope comprised of a front ply and a rear ply fastened together about all marginal edges, the front ply having an address receiving area and the rear ply including parallel perforated paths spaced a first given distance apart extending from a longitudinal marginal edge of the rear ply adjacent to one end of the envelope transversely across the rear ply to terminate at the opposite longitudinal marginal edge, the rear ply being cut along a straight line between two points on said paths spaced a second given distance from said opposite longitudinal edge to define with the path portions extending from said points to the first longitudinal edge a tab, said cut providing an opening to the interior of the envelope by means of which a person can grasp and pull the tab away from the remaining rear ply to provide a large transverse access opening into the interior of said envelope and (b) a loose insert in said envelope exposed when said tab is removed, whereby said mailer can be mass-produced by moving plies of paper in the direction of the width of the mailer, and said perforated paths defining said tab formed in the rear ply of the plies of paper while the same are moving.

2. A mailer according to claim 1, in which said first given distance is between one fifth and one seventh the length of said envelope and in which said second given distance is between one twentieth and one twenty-fifth the width of said envelope, said first and second given distances defining the length and width of a small rectangular flap disposed between said opening and said opposite longitudinal marginal edge which flap overlies the adjacent edge of said loose insert so that a person grasping said tab by means of said opening cannot inadvertently grasp the loose insert and possibly tear the same while removing said tab.

3. A mailer according to claim 2, including attachment means holding the end of said loose insert to the end of the envelope opposite to said end closest to said tab in a postion to assure that said flap will overlie said adjacent edge of said loose insert, said attachment means being responsive to a slight pulling force to separate and thereby free the loose insert for removal.

4. A mailer according to claim 1, including a top ply with image transfer provisions therebeneath overlying the front ply of said envelope so that an address formed on said top ply will be reproduced in said address receiving area of said front ply and said top ply can be removed and serve as a record as to the addressee, said loose insert comprising a return envelope and, two additional loose inserts with image transfer provisions therebetween so that a person receiving said mailing envelope can write a return message on one of the two additional loose inserts and mail it back in said return envelope, keeping the other of said two additional inserts as a copy of what was sent back.

* * * * *